US006206478B1

(12) United States Patent
Uehara et al.

(10) Patent No.: US 6,206,478 B1
(45) Date of Patent: Mar. 27, 2001

(54) TUNNEL EXCAVATOR WITH CRAWLER DRIVE AND ROOF SUPPORT BEARING FRAMES

(75) Inventors: Toshiaki Uehara, Yachiyo; Takanobu Miki, Chita-gun; Tomofumi Ishino, Chita, all of (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 09/315,583

(22) Filed: May 20, 1999

(30) Foreign Application Priority Data

May 22, 1998 (JP) ..... 10-141511

(51) Int. Cl.[7] ..... E21D 9/06; E21D 9/08; E21D 9/10

(52) U.S. Cl. ..... 299/33; 299/59; 299/61; 405/141; 405/142; 405/288

(58) Field of Search ..... 299/31–33, 55, 299/56, 59, 61; 405/132, 138, 141–143, 288, 290

(56) References Cited

U.S. PATENT DOCUMENTS 2,862,700 * 12/1958 Gonski ..... 299/59 X
4,953,914 * 9/1990 LeBegue ..... 299/33 X
5,192,116 * 3/1993 Turner et al. ..... 299/31 X
5,234,257 * 8/1993 Sugden et al. ..... 299/33 X

* cited by examiner

*Primary Examiner*—David Bagnell
*Assistant Examiner*—Sunil Singh
(74) *Attorney, Agent, or Firm*—McCormick, Paulding & Huber LLP

(57) ABSTRACT

The tunnel excavator (1) includes a cutter supporting body (3) provided with cutters (2) for excavating the earth. The tunnel excavator also includes crawlers (13) for moving backwards and forwards, and upper and side bearing frames (15, 16) which move radiantly until they contact an inner surface of the excavation (12). Forwards movement is accomplished by propelling the cutter supporting body (3) with the crawlers (13) while the bearing frames (15, 16) are in contact with the inner surface of the excavation (12). Forwards movement without lateral slippage can be achieved because the cutter supporting body (3) is guided through the excavation (12) by the bearing frames (15, 16). Backwards movement is achieved by radially withdrawing the bearing frames (15, 16) from the inner surface of the excavation (12) and reversing the crawlers (13). Tunneling can therefore be accomplished regardless of the state of the floor. Internal instruments can be protected from falling earth because the earth can be supported by the bearing frames (15, 16).

14 Claims, 14 Drawing Sheets

TUNNEL EXCAVATOR WITH CRAWLER DRIVE AND ROOF SUPPORT BEARING FRAMES

BACKGROUND OF THE INVENTION

1. Field of the Invention

The present invention relates to a tunnel excavator for tunneling into the ground, such as in coal mines.

2. Description of the Related Art

Tunnel excavators used in excavating ground such as in coal mines include those comprising a forward body which is provided with a cutter for excavating the ground and rear body connected to the forward body by a propulsion jack. Such tunnel excavators bore into the ground as they move like inchworms, expanding and contracting the propulsion jack while a rear gripper established on the rear body and front gripper established on the forward body alternately push against and are separated from the tunnel.

Specifically, the propulsion jack is extended with the front gripper separated from the tunnel while the rear gripper is pressed against the tunnel and the front body moves forward relative to the rear body. Next, once the propulsion jack has extended by the prescribed stroke length, the propulsion jack is contracted with the rear gripper separated from the tunnel while the front gripper is pressed against the tunnel and the rear body is drawn forward to the forward body.

With this tunnel excavator, the propulsion reaction force of the propulsion jack is borne by the tunnel through the front gripper or rear gripper. In areas having faults, therefore, the propulsion reaction force is not attained from the grippers because the ground is broken up and it becomes impossible to tunnel forward. In areas where the ground is not strong, tunneling becomes impossible because the tunnel (walls) is destroyed by the pressure of the grippers. Backwards movement of the excavator is also difficult.

On the other hand, there are tunnel excavators which move forwards on crawlers instead of using grippers. This type of tunnel excavator is often difficult to operate because lateral sliding or the like occurs in areas where the coefficient of friction of the tunnel floor in contact with the crawlers is different on each side of the crawlers. Such tunnel excavators do not have a bearing frame to support the earth (i.e., roof and ribs of the tunnel). In the event of a fall, the various instruments constituting the excavator are damaged.

SUMMARY OF THE INVENTION

It is an object of the present invention to provide a tunnel excavator which can tunnel without being influenced by the state of the ground or earth (floor, ribs and roof of the tunnel).

Another object of the present invention is to provide a tunnel excavator which can easily move backwards regardless of the conditions of the ground or earth.

Still another object of the present invention is to provide a tunnel excavator which can prevent lateral slippage regardless of the conditions of the ground or earth.

Yet another object of the present invention is to provide a tunnel excavator which can protect instruments associated there-with from falling earth.

According to one aspect of the present invention, there is provided a tunnel excavator including bearing frames which are movable in a radial direction (or radiantly) to contact the inner surface of an excavation (tunnel). The excavator further includes crawlers to provide forwards and backwards propulsion. The crawlers are installed on a cutter supporting body which is originally provided for a cutter for excavating earth. With this tunnel excavator, forwards movement is carried out by the crawlers propelling the cutter supporting body with the bearing frames in contact with the inner surface of the excavation. Since the cutter supporting body is guided within the excavation by the bearing frames as it moves forward, forwards movement without lateral sliding can thereby be achieved. Backwards movement can be easily achieved by moving the bearing frames in a radially inward direction so as to separate from the inner surface of the excavation and moving the crawlers in reverse. Tunneling can be carried out regardless of the state of the earth because forward movement uses crawlers instead of stretching grippers against the tunnel as before. Furthermore, the instruments within the excavator can be protected from falling earth because the earth are supported by placing the bearing frames in contact with the inner surface of the excavation.

In sum, the present invention enables tunneling without being influenced by conditions of the earth, easy backward movements of the excavation machine, prevention of lateral sliding of the excavation machine, and protection of equipments in the excavation machine.

An anchor body, which is provided with separate crawlers, may be disposed behind the cutter supporting body, and the anchor body and cutter supporting body may be connected by means of a propulsion jack. When the crawlers of the cutter supporting body do not provide sufficient propulsion, greater propulsion can be attained by extending the propulsion jack with the anchor body as an element for receiving the reaction force.

Grippers, to press against or separate from the excavation, may be established on the anchor body, so as to fix or release the anchor body with respect to the excavation. If that is the case, the propulsion of the propulsion jack can be increased because the anchor body can be fixed in the excavation by the grippers.

A sub-cutter, which moves upwards and downwards within a prescribed range, may also be installed on the cutter supporting body so as to vary the height of the traveling surface of the crawlers. If that is the case, the angle at which the excavator tunnels can be directed upwards and downwards upon changing the height of the traveling surface of the crawlers by moving the sub-cutter upwards or downwards.

A plurality of propulsion jacks may be disposed in a horizontal direction at prescribed intervals. If that is the case, the extension forces and strokes of these propulsion jacks may be adjusted to change the excavation direction of the excavator to the right or left.

DETAILED DESCRIPTION OF THE INVENTION

Below, the embodiments of the present invention are described with reference to the attached figures.

Figure 1:
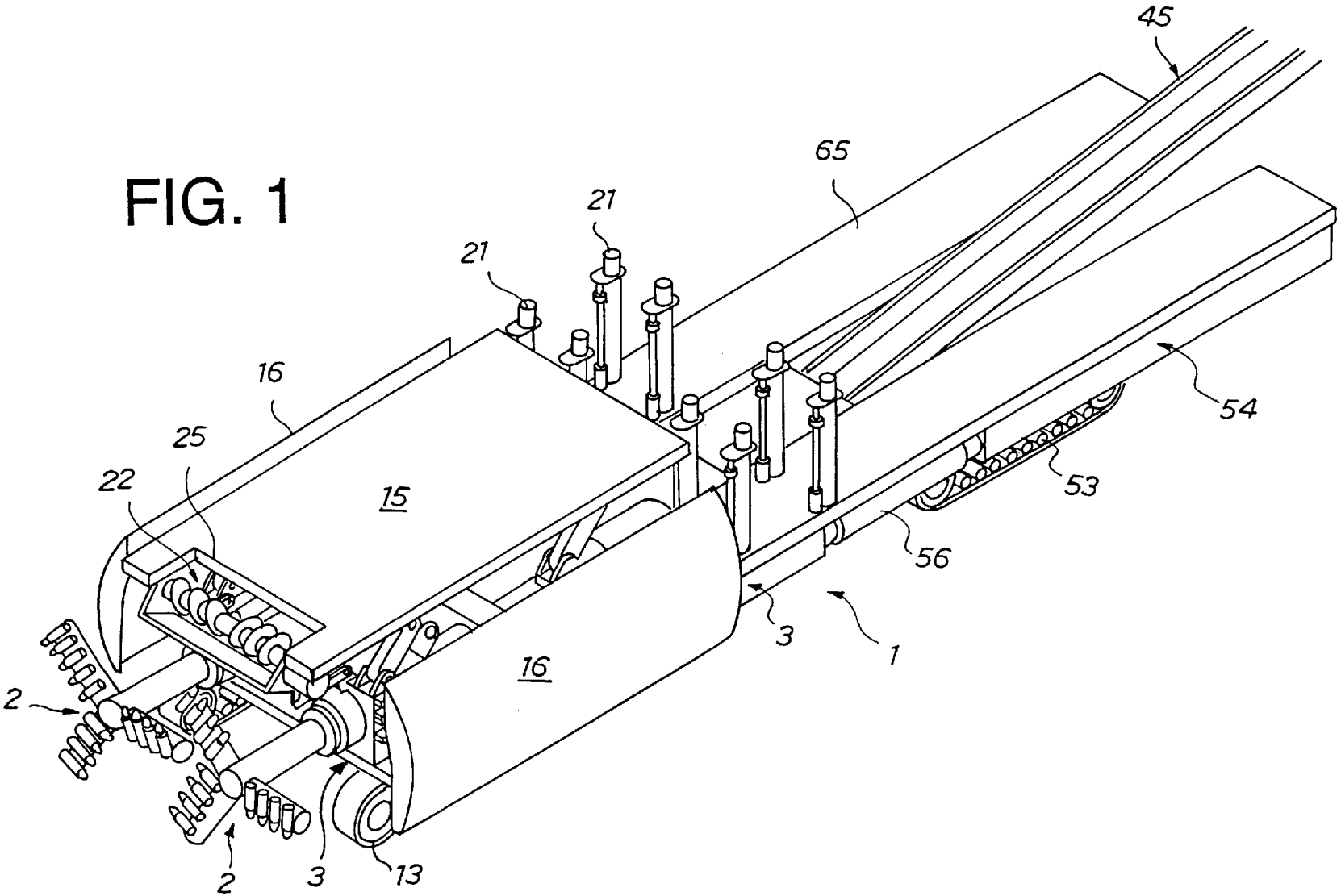
FIG. 1 is a perspective view of a tunnel excavator according to an embodiment of the present invention.
Figure 2:
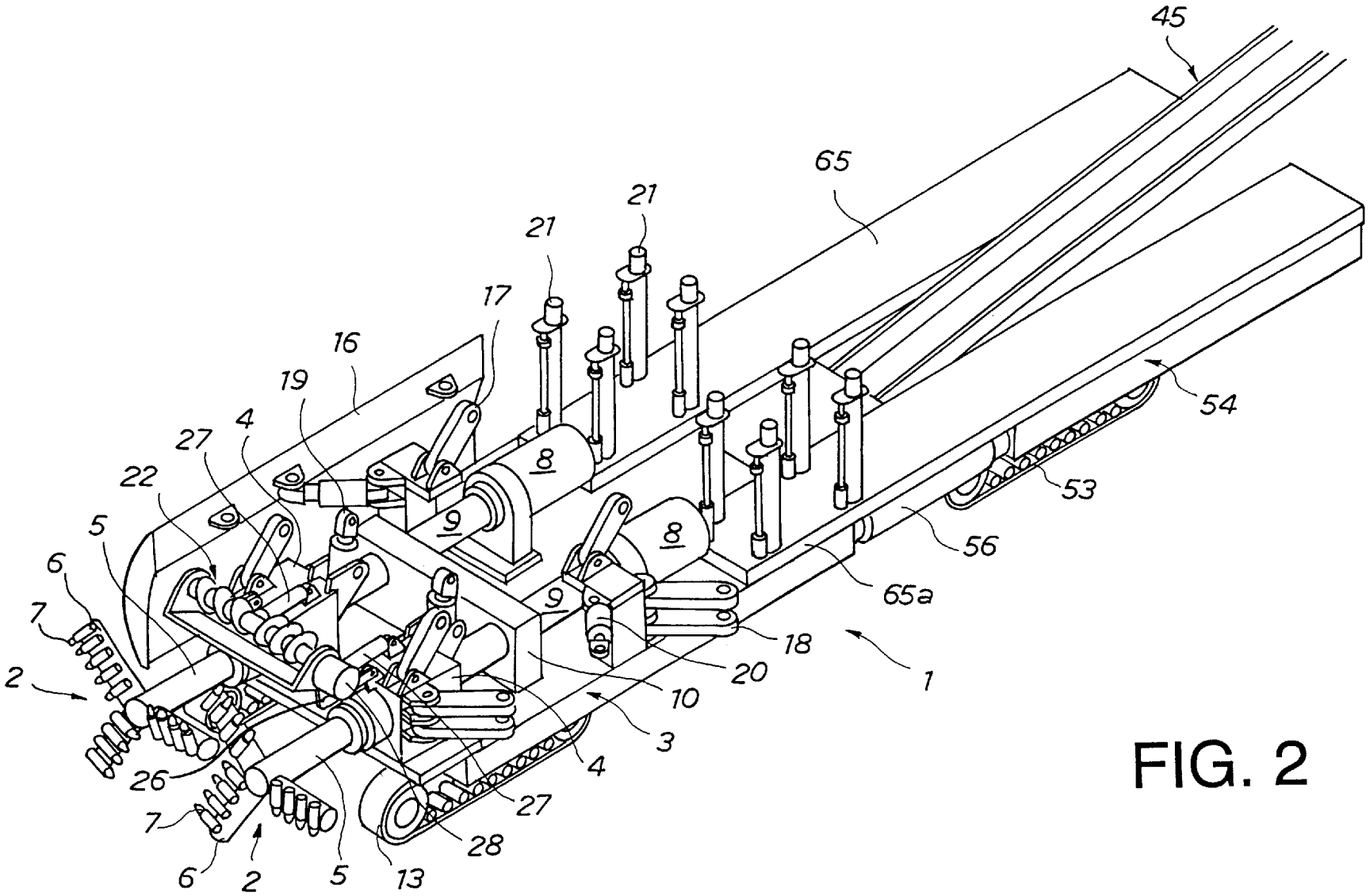
FIG. 2 is another perspective view showing the tunnel excavator shown in FIG. 1 with the bearing frames removed.

FIGS. 1 and 2 show schematic diagrams of a tunnel excavator 1 for tunneling into earth mixed with coal in a coal mine. FIGS. 3 through 11 show details of the tunnel excavator 1. The same explanation applies to the tunnel excavator shown in FIGS. 1 and 2 and the tunnel excavator shown in FIGS. 3 through 11 because these are essentially the same, although they have some differences.

Figure 5:
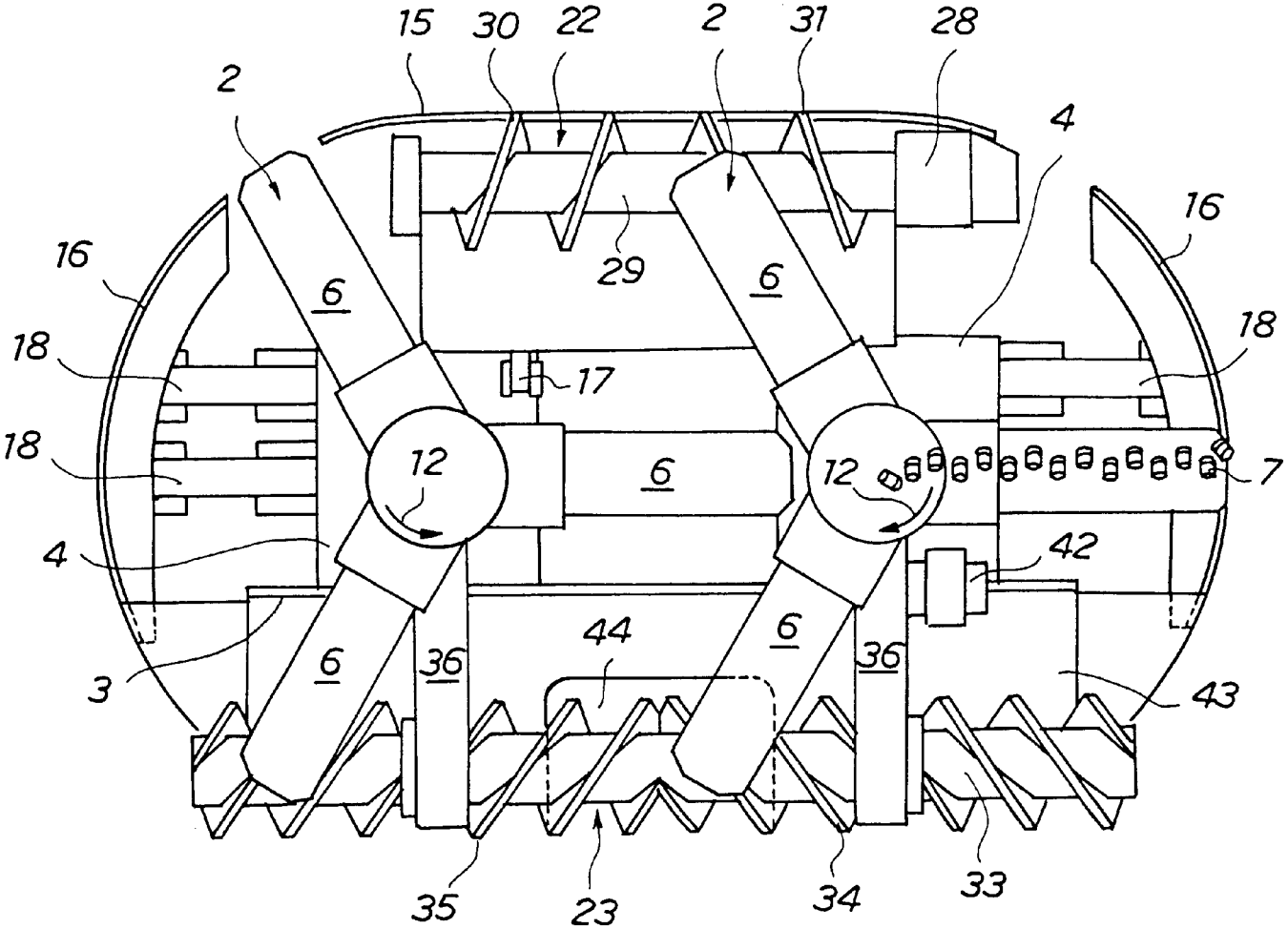
FIG. 5 is a cross sectional view of FIG. 4 along line V—V.

Referring to FIGS. 1 and 2, this tunnel excavator 1 includes a cutter supporting body 3 whereon two cutters 2 for excavating earth are arranged. These cutters 2 are mounted in a horizontal row and separated by a prescribed distance on the cutter supporting body 3, as shown in FIG. 5. The number of cutters 2 is not restricted to two and may be one, three or more. When a plurality of cutters 2 is used, the cutters do not have to be mounted in a horizontal row and separated by prescribed intervals as shown in the pictured example; they may be mounted in a vertical direction and separated by prescribed intervals, or disposed in a triangle or square.

As illustrated in FIGS. 2, 5, 9, and 10, each cutter 2 includes the following: a rotating shaft 5 which is rotatably supported by a support block 4 established on the cutter supporting body 3, three cutter spokes 6 mounted at equal intervals around the circumference of the front end of the rotating shaft 5, and cutting picks 7 mounted on each cutter spoke 6 for essentially excavating the earth. The six cutter spokes 6 on the two cutter 2 are disposed so as to intermesh without interfering with each other. It should be noted that the number of cutter spokes 6 on each cutter 2 is not restricted to three and may be two, four, or more.

Figure 6:
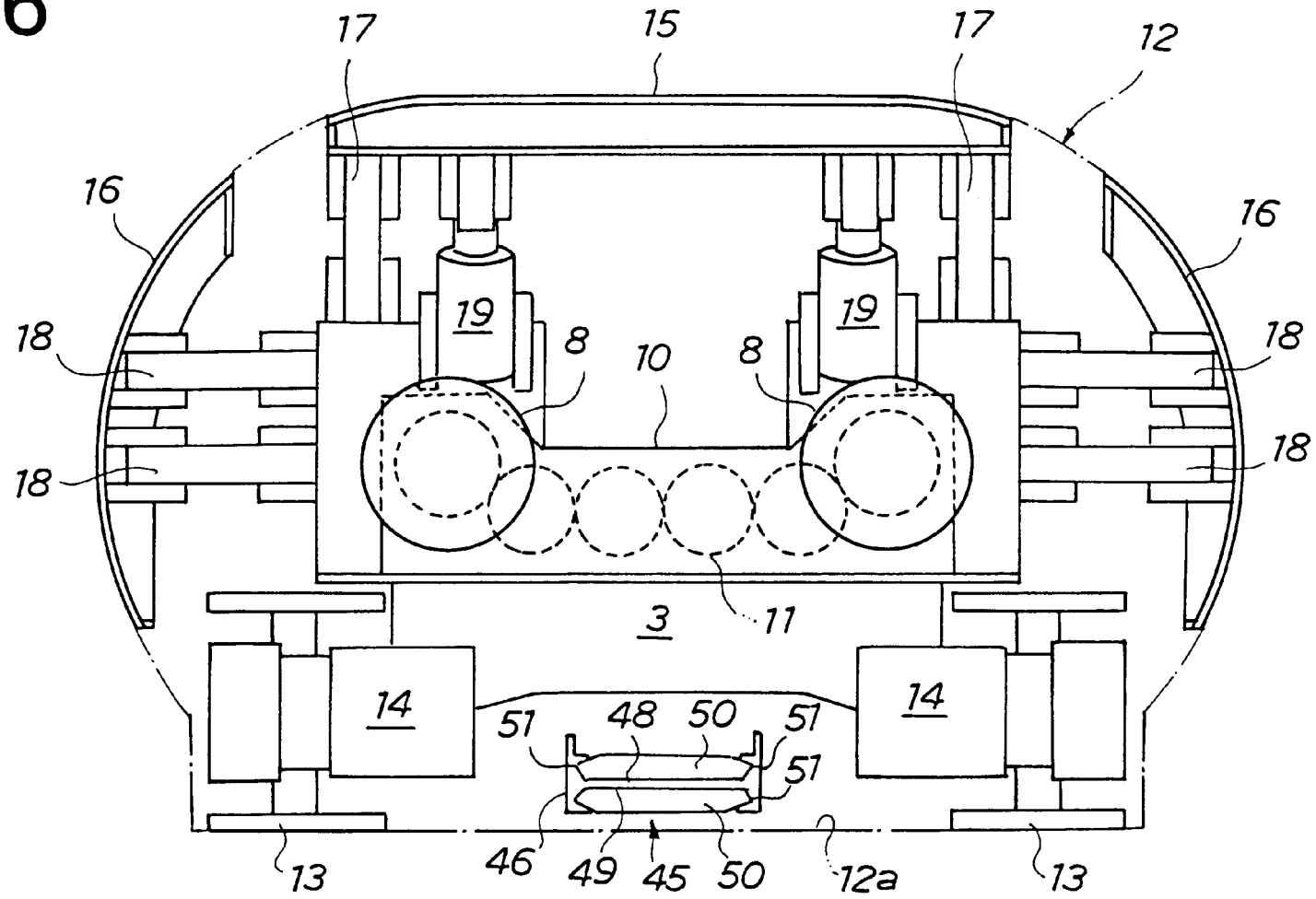
FIG. 6 is a cross sectional view of FIG. 4 along line VI—VI.

The rotating shaft 5 of each cutter 2 is connected by means of a synchronization gear box 10 to a drive shaft 9 of an associated driving motor 8 (electric or hydraulic motor) mounted on the cutter supporting body 3. As shown in FIG. 6, the synchronization gear box 10 contains a sequence of plural gears 11, and holds the two rotating shafts 9 of the cutters 2 in the prescribed phases respectively while rotating them in opposite directions at the same speed. The gear box 10 prevents interference (collisions) among the cutter spokes 6 disposed so as to intermesh. As indicated by the arrows 12 in FIG. 5, each cutter rotates in a direction such that the spoil is scraped to the center.

A pair of crawlers 13 is arranged on the bottom portion of the cutter supporting body 3, as shown in FIGS. 2 and 6. These crawlers 13 are spaced at a prescribed distance from each other crosswise to the tunnel and travel along the floor 12*a* (FIG. 6) of the excavation 12. As best seen in FIG. 6, the right and left crawlers 13 are driven independently by associated drive motors (electric or hydraulic motors) and function as the means for moving the cutter supporting body 3 forwards and backwards. Therefore, the excavation 12 is formed to the rear of the cutters when the cutter supporting body 3 is moved forwards by the crawlers 13 with the cutters 2 turning. In other words, the present tunnel excavator 1 can tunnel regardless of the state of the ground because the excavator 1 is moved forwards by the crawlers 13, unlike a conventional excavator which uses grippers to stretch the excavation 12 when it moves forwards and backwards.

As illustrated in FIGS. 2, 6, 7, 9, and 10, an upper bearing frame 15 and side bearing frames 16 are mounted by means of link mechanisms 17, 18 (parallel link mechanisms, or the like) and jacks 19, 20 (electric jacks, hydraulic jacks, or the like) on the cutter supporting body 3. The upper bearing frame 15 and side bearing frames 16 move radially so as to contact the roof 12*b* (upper surface) and ribs (side surfaces) 12*c* of the excavation 12. As best shown in FIGS. 1 and 5, the upper bearing frame 15 is formed of a generally flat panel and each of the side bearing frames 16 has a curving form which matches the arc that the associated cutter 2 draws when it rotates.

The bearing frames 15, 16 are formed so as to cover the cutter supporting body 3 from directly behind the cutters 2 to directly before roof bolters 21 (will be discussed below). The bearing frames 15, 16 support earth dropping from the inner surface (roof and ribs) of the excavation 12 and protect the driving motors 8, synchronization gear box 10, link mechanisms 17, 18, and the like. In other words, because the earth can be supported by placing the bearing frames 15, 16 in contact with the inner surface of the excavation 12, the bearing frames can protect internal instruments from falling earth. The cutter supporting body 3 is moved forward by the crawlers 13 with the bearing frames 15, 16 placed in contact with the inner surface of the excavation 12 and the jacks 19, 20 extended. The cutter supporting body 3 is thereby guided along the excavation 12 without any lateral slippage.

Lateral slippage or the like usually occurs and operation becomes difficult when the coefficient of friction of the ground surface (floor 12*a* of the excavation 12) varies between the crawlers 13 on the right and left. In the present embodiment, however, stable progress with substantially no lateral slippage is ensured even under those conditions because the bearing frames 15, 16 are in contact with or very close to the inner surface of the excavation 12 and guide the cutter supporting body 3, which is moved forwards by the crawlers 13, along the excavation 12. At such a time, the bearing frames 15, 16 may be fixed relative to the inner surface of the excavation 12 by holding the jacks 19, 20 at a prescribed stroke. In this case, there may occasionally be small clearance between the bearing frames 15, 16 and the inner surface of the excavation, but such small clearance would not affect appropriate guiding without lateral slippage. Alternatively, it is also satisfactory that the bearing frames 15, 16 may always be forced in light contact with the inner surface of the excavation 12 by very gently or softly extending the jacks 19, 20.

Figure 9:
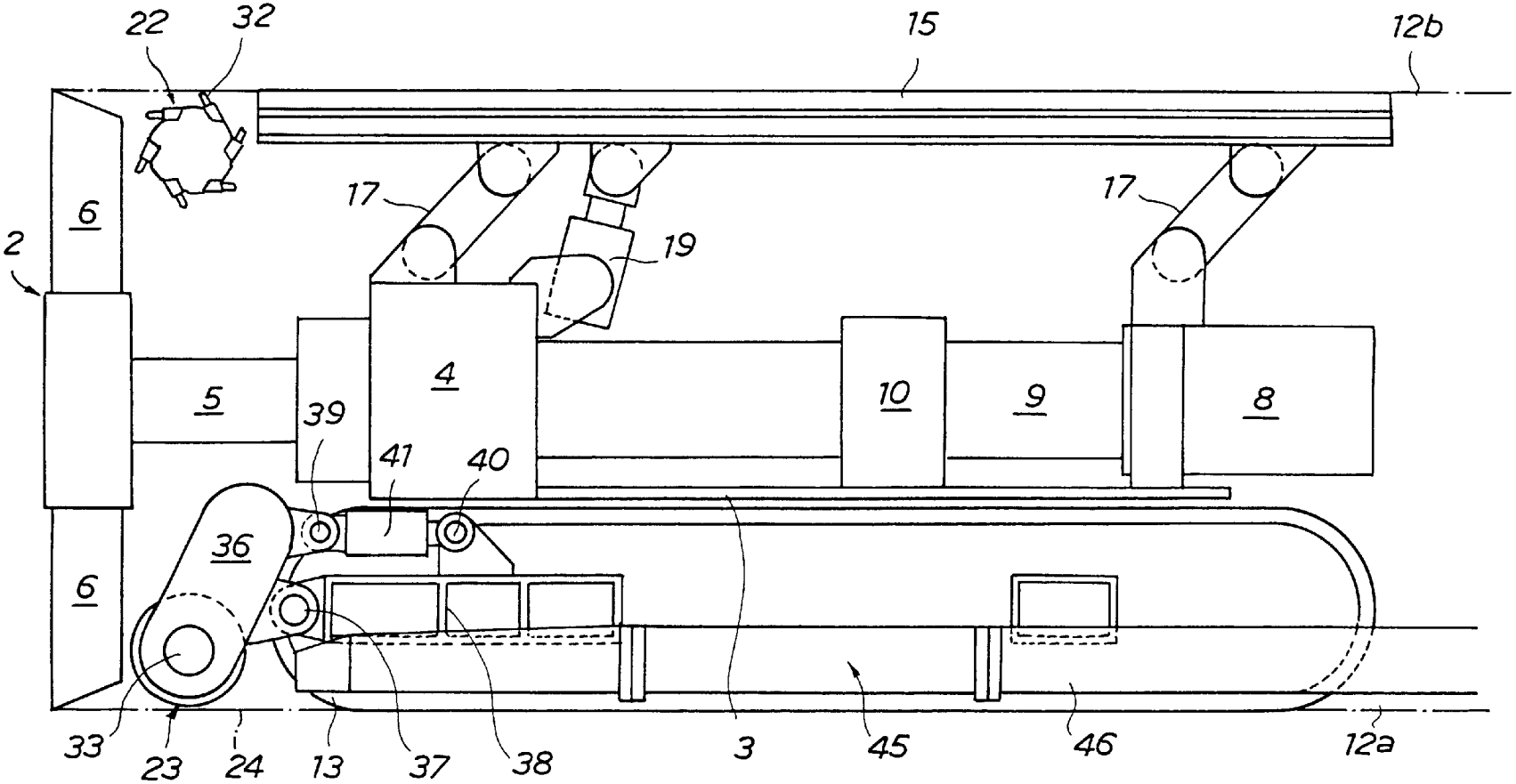
FIG. 9 is a cross sectional view of FIG. 3 along line IX—IX.
Figure 10:
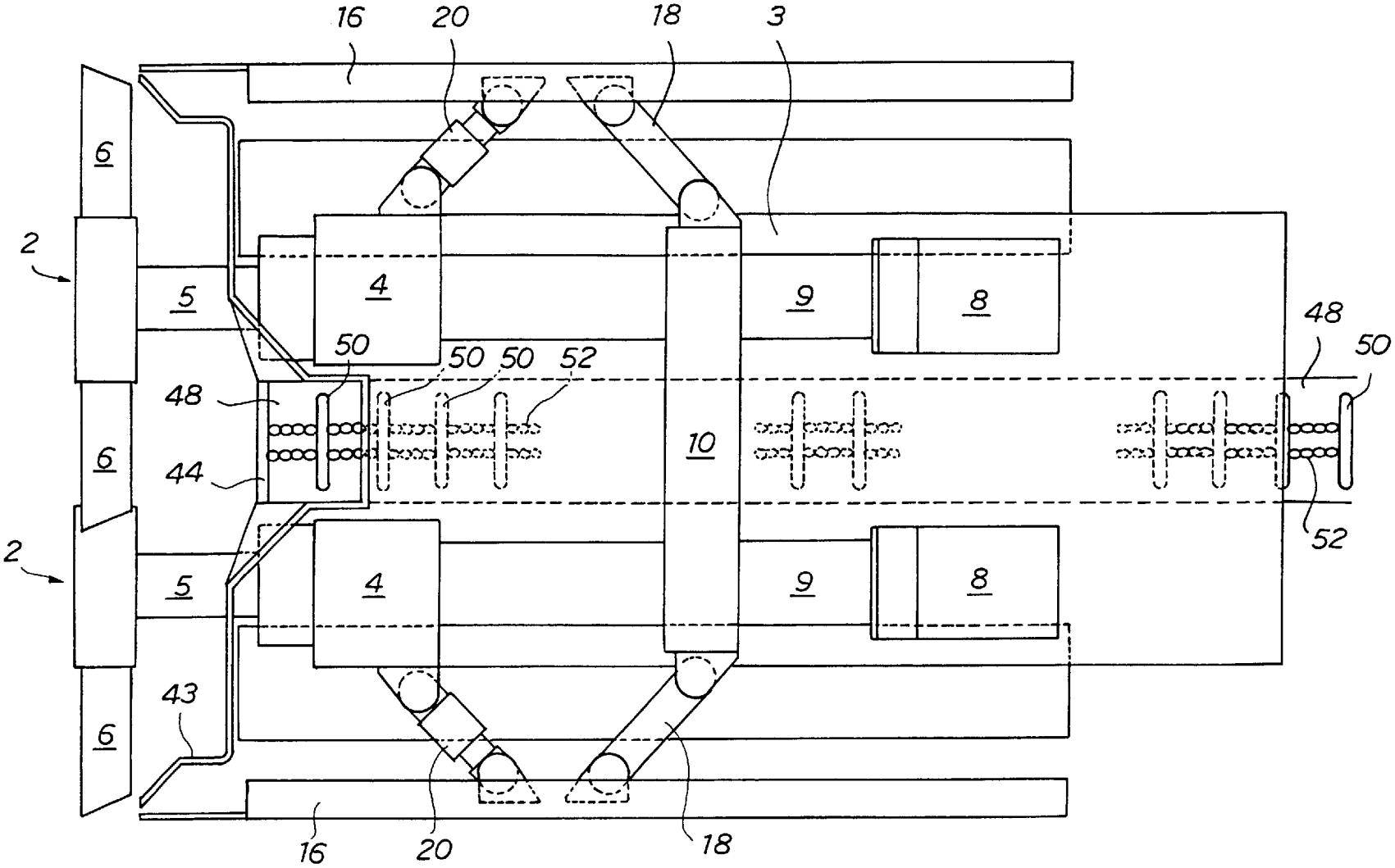
FIG. 10 is a cross sectional view of FIG. 4 along line X—X.

As illustrated in FIGS. 2, 5, 9, and 11, sub-cutters 22, 23 are disposed at an upper level and lower level on the front portion of the cutter supporting body 3. The sub-cutters 22, 23 have the purpose of excavating areas out of range of the rotating cutters 2 and which cannot be excavated by the cutters 2. This upper sub-cutter 22 and lower sub-cutter 23 are disposed to the rear of the cutters 2 as understood from FIG. 1. The lower sub-cutter 23 is disposed in front of the crawlers 13 so that it can form (excavate) the floor 24 before the crawlers 13 as shown in FIG. 9. As shown in FIG. 1, a cutout portion 25 is formed in the upper bearing frame 15 so as to enclose the upper sub-cutter 22.

The upper sub-cutter 22 is mounted on the support block 4 of the cutter supporting body 3 by means of the link mechanism 26 as shown in FIG. 2. The upper sub-cutter 22 moves upwards and downwards within a prescribed range upon extension and contraction of the jacks 27 (electric or hydraulic jacks). As shown in FIG. 5, the upper sub-cutter 22 includes a rotary shaft 29 which is rotated by a motor 28 and screw blades 30, 31 which spiral in opposite directions toward the center from each end of the rotary shaft 29. This sub-cutter 22 therefore pulls spoil from the ends toward the center as it rotates. Cutting picks 32 are mounted on the screw blades 30, 31 as shown in FIG. 9.

Figure 11:
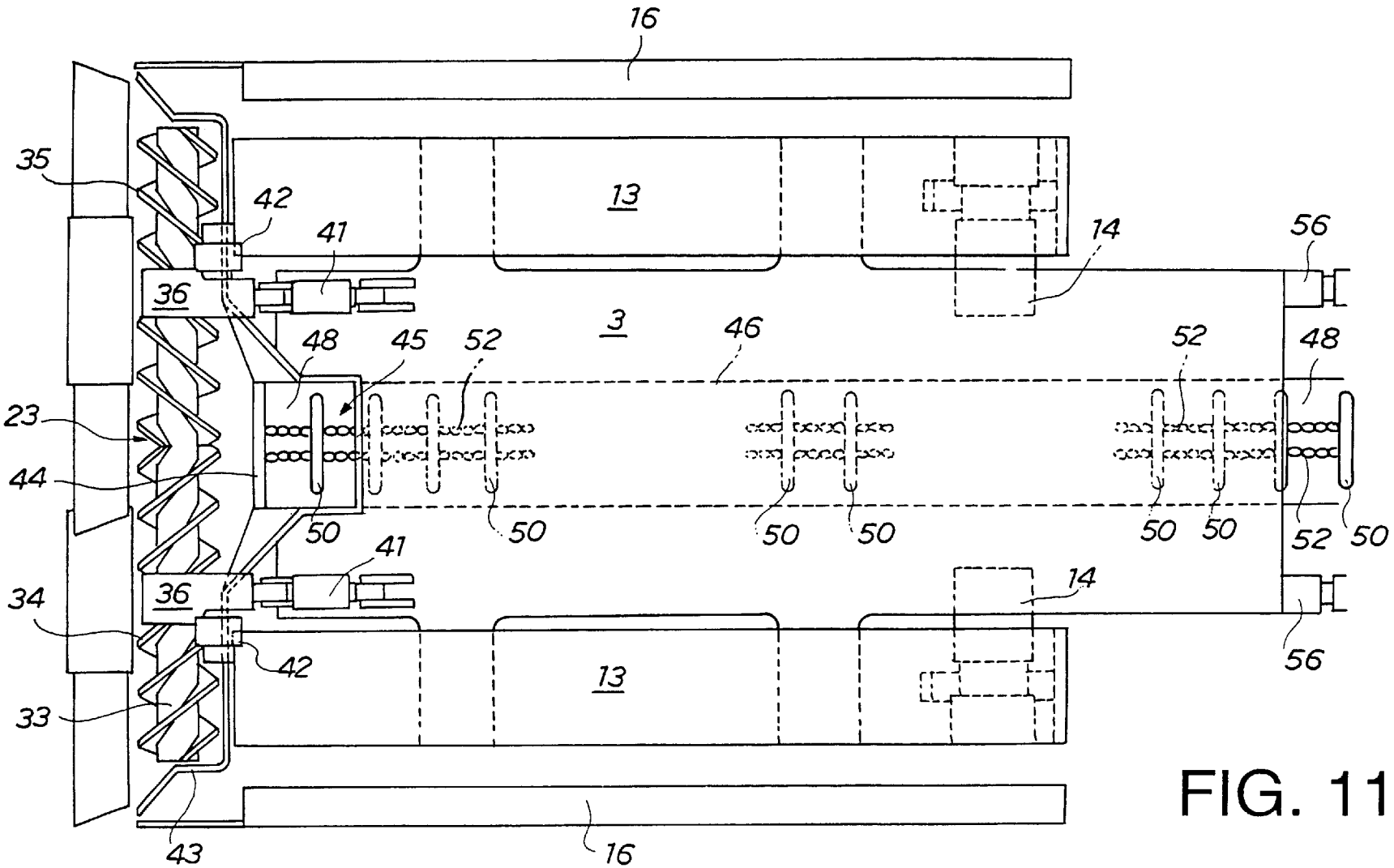
FIG. 11 is a cross sectional view of FIG. 4 along line XI—XI.

As shown in FIGS. 5 and 11, the lower sub-cutter 23 includes a rotary shaft 33 extending horizontally and screw blades 34, 35, spiraling in opposite directions toward the center from each end of the rotary shaft 33. This sub-cutter can also gather spoil from the ends towards the center. Cutting picks, not shown, like those on the upper sub-cutter 22 are mounted on the screw blades 34, 35. The length of the rotary shaft 33 of the lower sub-cutter 23, specifically, the length of the excavation zone, is determined to match the spacing between the right and left crawlers 13, as shown in FIGS. 6 and 11. This guarantees a traveling surface for the crawlers 13.

The rotary shaft 33 of the lower sub-cutter 23 is held by and turns within the lower portion of arm elements 36 as shown in FIGS. 5, 9, and 11. In the illustrated embodiment, two arm elements 36 are provided in a direction crosswise to the tunnel and are separated by a prescribed distance. The central portions thereof are rotatably supported by the block 38 established on the cutter supporting body 3 by means of pins 37. The jacks 41 (electric or hydraulic jacks) are held between the upper portions of the arm elements 36 and the block 38 by means of pins 39, 40 respectively. With this constitution, extending and contracting the jacks 41 turns the arm elements 36 around the pins 37 and moves the lower sub-cutter upwards and downwards within the prescribed range.

Driving motors 42 (electric or hydraulic motors) are mounted on the upper portions of the arm elements 36 in order to drive the rotary shaft 33 of the lower sub-cutter 23. Rows of gears, chains, and the like (not shown) are housed inside the arm elements 36 for transferring the rotary force of the drive motor 42 to the rotary shaft 33 of the lower sub-cutter 23 respectively. By moving the lower sub-cutter 23 rotated by the driving motor 42 upwards and downwards by the jacks 41, the height of the traveling surface 24 of the crawlers 13 formed directly behind the lower sub-cutter 23 (FIG. 9) can be changed and therefore the up and down orientation of the cutter supporting body 3 can be controlled.

Figure 4:
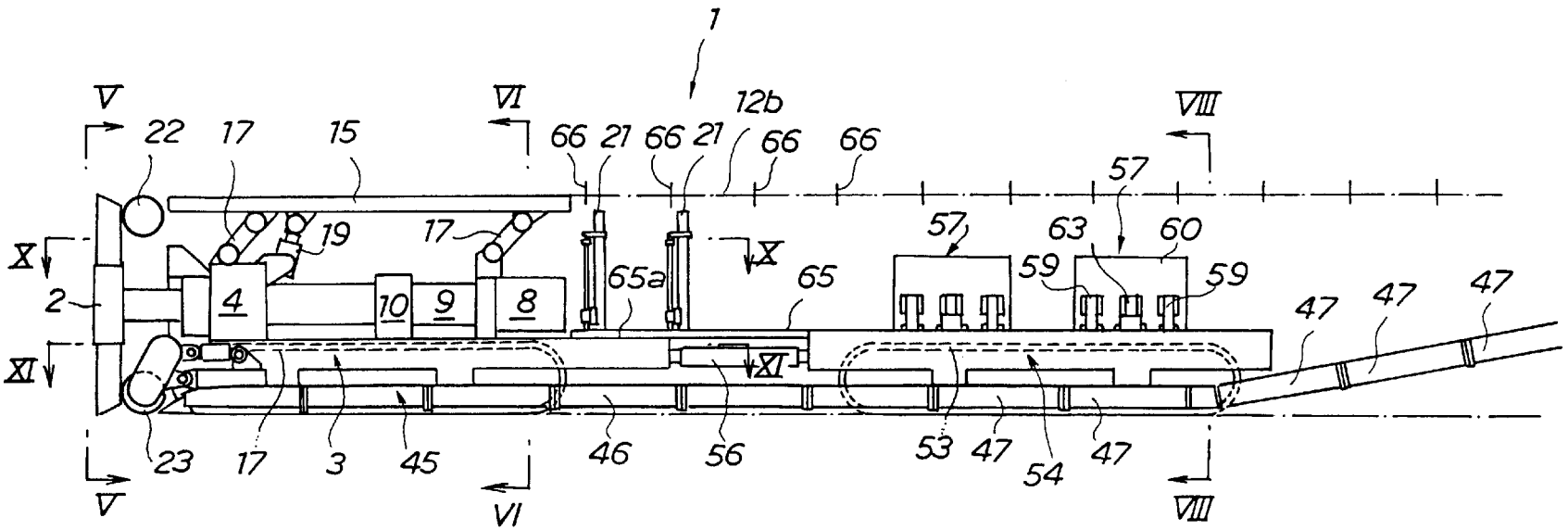
FIG. 4 is a side view of the tunnel excavator shown in FIG. 1.

As shown in FIGS. 5 and 11, a collector plate 43 is mounted on the cutter supporting body 3 and located to the rear of the cutters 2 and the sub-cutter 23. The collector plate 43 gathers the excavated spoil. The collector plate 43 tapers towards the spoil outlet 44 in the center so as to gather the spoil towards the spoil outlet 44. A chain conveyor 45 for transporting spoil towards the rear is located behind the spoil outlet 44. The chain conveyor 45 includes a conduit or channel element 46 extending towards the rear of the tunnel, as shown in FIGS. 6, 9, and 11. The illustrated conduit element 46 includes a plurality of pieces 47 as shown in FIG. 4. Additional conduit pieces 47 are attached as the cutter supporting body 3 advances for excavation.

Referring to FIG. 6, the upper surface of the conduit element 46 forms a carrier surface 48 and the lower surface forms a return surface 49. Depressed portions 51 to anchor paddles 50 are formed in both sides of the surfaces 48, 49. As illustrated in FIG. 11, a plurality of paddles 50 is disposed on the carrier surface 48 and return surface 49 at prescribed intervals lengthwise to the conduit element 46. A pair of parallel endless chains 52 connect these paddles 50. The With this constitution, the spoil is transported to the rear by the paddles 50 on the carrier surface 48 upon the circulation of the endless chains 52 with an associated driving means (not shown).

Figure 3:
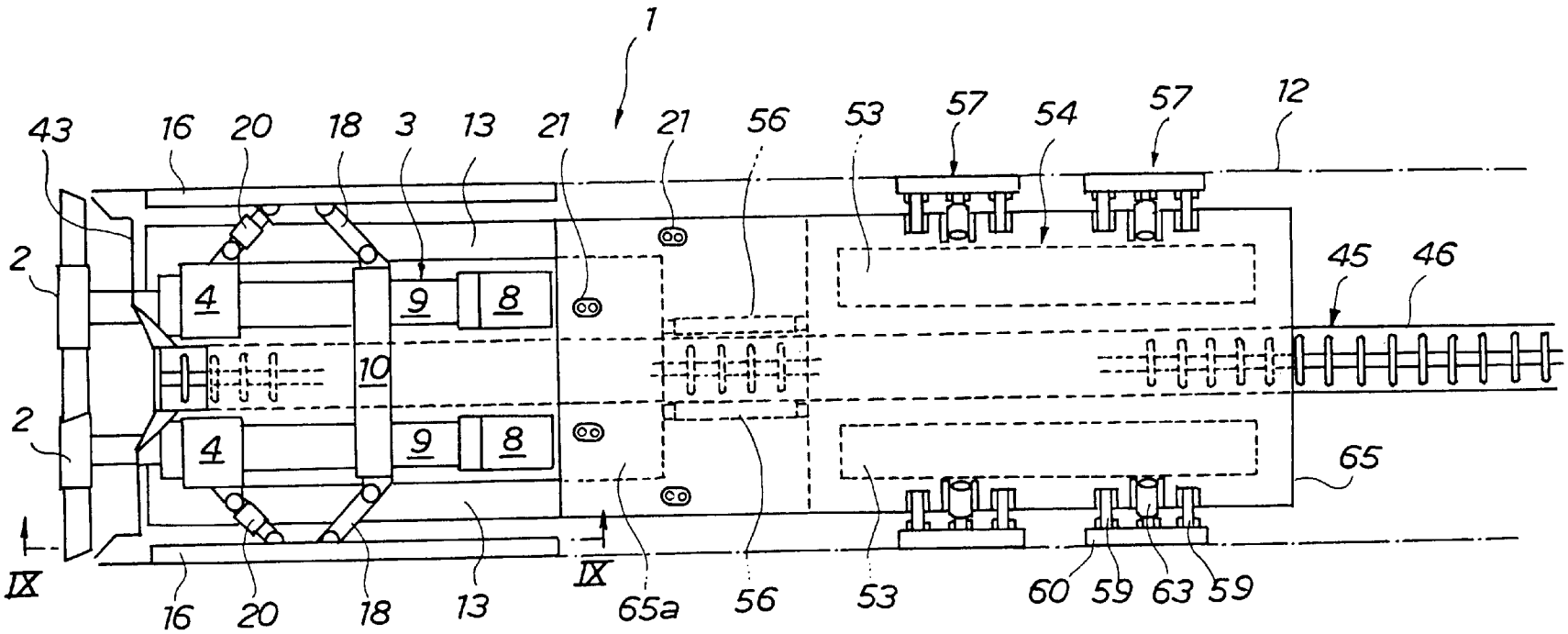
FIG. 3 is a plan view of the tunnel excavator shown in FIG. 1.
Figure 8:
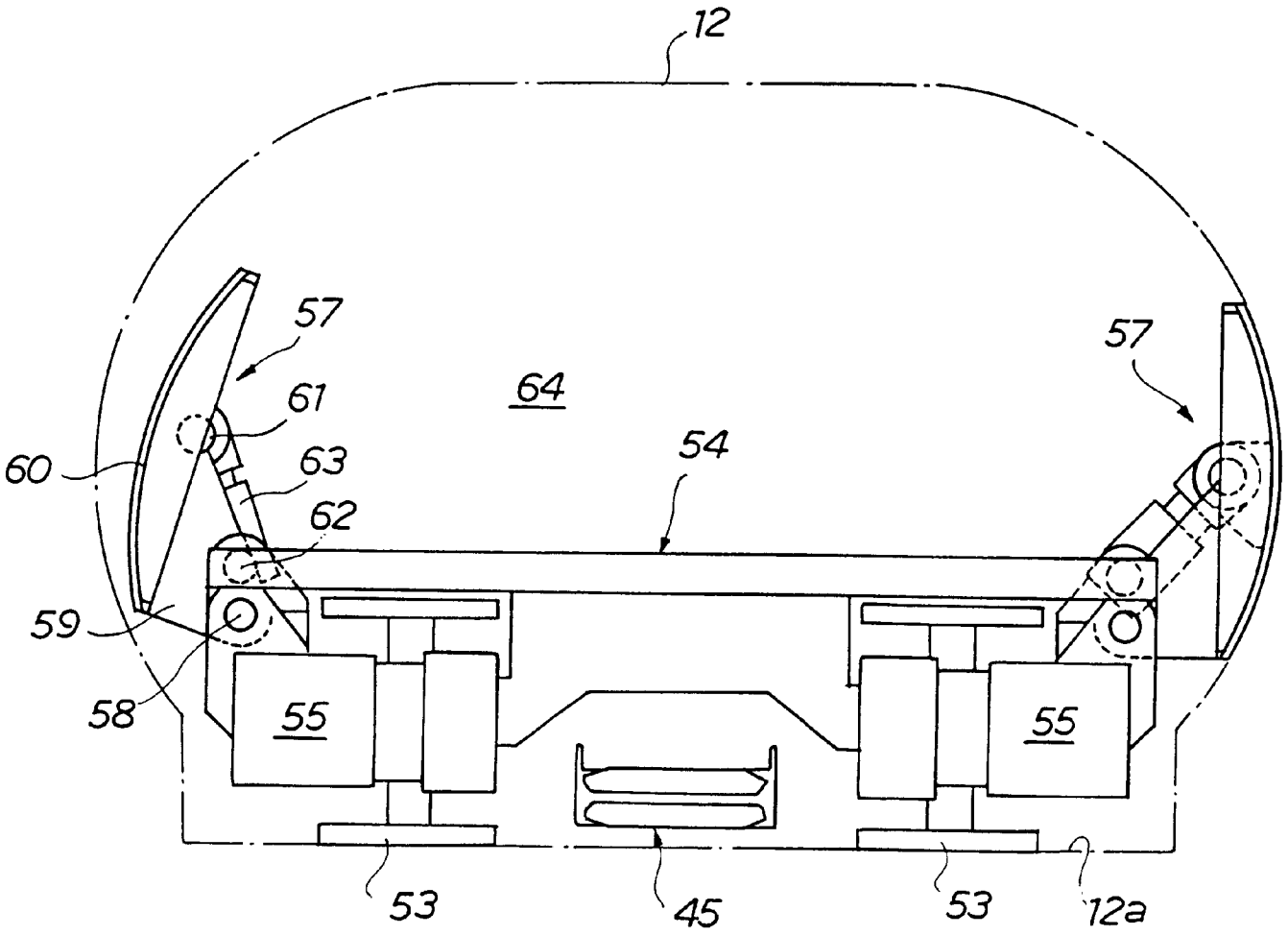
FIG. 8 is a cross sectional view of FIG. 4 along line VIII—VIII.

As illustrated in FIGS. 2, 3, and 4, an anchor body 54, which is provided with another crawlers 53, is disposed to the rear of the cutter supporting body 3. As also shown in FIG. 8, a pair of crawlers 53, separated by a prescribed distance crosswise to the tunnel, are provided on the floor portion of the anchor body 54. These crawlers 53 are driven independently by driving motors 55 (electric or hydraulic motors). The anchor body 54 and cutter supporting body 3 are connected by means of a pair of propulsion jacks 56 (hydraulic or electric jacks), separated by a prescribed distance crosswise to the tunnel, as also depicted in FIGS. 3 and 11. The stroke length and force of extension for the each of the propulsion jacks 56 can be controlled individually.

The anchor body 54 is used to increase propulsion toward the working face in the event of insufficient propulsion when using only the crawlers 13 provided on the cutter supporting body 3. Specifically, when additional propulsion force is needed, the anchor body 54 is halted and the propulsion jack 56 is extended, which functions as an element for receiving reaction force. In such a case, the forward propulsion of the cutter supporting body 3 becomes the sum of the propulsion of the crawlers 13 on the cutter supporting body 3 and the extension force of the propulsion jacks 56. The reaction force thereof is transmitted to the floor 12*a* of the excavation 12 by means of the crawlers 53 on the anchor body 54.

The cutter supporting body 3 can be pushed forward at an angle (i.e., diagonally) by using different extension forces and stroke lengths for each jack (right and left jacks) 56 when the propulsion jacks 56 are extended. The horizontal orientation of the advancing cutter supporting body 3 can thereby be controlled. Controlling the stroke length of each of the jacks 56 can result in very precise curves. If the propulsion jacks 56 are extended to the prescribed stroke length, they are reset when contracted by the crawlers 53 moving the anchor body 54 forwards. When a curve is formed, the side bearing frames 16 on both sides are withdrawn from the ribs of the excavation to leave space for excavation to the inside of the curve. A smooth arcuate tunnel can therefore be excavated without the side bearing frames 16 scraping on the excavation 12.

As illustrated in FIGS. 3, 4, and 8, grippers 57 to press against or separate from the excavation 12 are established on the anchor body 54, in order to affix or release the anchor body 54 to the excavation 12. The grippers 57 include the following: rotary arms 59 mounted rotatably on the anchor body 54 by means of pins 58; shoes 60 to be pressed against and released from the ribs of the excavation 12 and mounted on the rotary arms 59; and jacks 63 (electric or hydraulic jacks) held between the shoes 60 and the anchor body 54 by pins 61, 62 for rotating the rotary arms 59 (FIG. 8).

It should be noted that the grippers 57 are not limited to the illustrated and described constitution. For example, the grippers 57 may have a structure similar to the link mechanisms 17, 18 as for the bearing frames 15, 16 shown in FIGS. 2, 9, and 10. However, a wide working space 63 is ensured over the anchor body 54 if the rotary arms 59 as in the present embodiment are employed.

Pressing the shoes 60 of the grippers 57 to the excavation 12 and affixing the anchor body 54 to the excavation 12 can prevent the anchor body 54 from slipping to the rear, which can occur when the propulsion jacks 56 are extended. Referring particularly to FIG. 8, in the case of a small coefficient of friction between the crawlers 53 of the anchor body 54 and the floor 12*a* of the excavation 12, the anchor body 54 slides to the rear when the propulsion jacks 56 are extended and cannot effectively transfer the extension force of the propulsion jacks 56 to the cutter supporting body 3. In the present embodiment, however, the slippage can be prevented or significantly reduced by affixing the anchor body 54 to the excavation 12 with the grippers 57. The extension force of the propulsion jacks 56 can thereby be transferred to the cutter supporting body 3 with certainty and the forward propulsion of the cutter supporting body 3 can be increased. Paradoxically, the forward propulsion of the cutter supporting body 3 can be increased because the slippage does not occur even if the propulsion of the propulsion jacks 56 is increased.

As illustrated in FIGS. 2, 3, and 4, working deck 65, to provide a work area for workers, are attached to the anchor body 54. The front sections 65*a* of the working deck 65 are slidably placed on the rear portion of the cutter supporting body 3. The working deck 65 is held still in relation to the excavation 12, even when the propulsion jacks 56 are extended and the cutter supporting body 3 is moving forwards with respect to the anchor body 54. In other words, even if the cutter supporting body 3 moves forwards, the working deck 65 does not move as long as the propulsion jacks 56 are actuated within the range of their strokes. In this way, the working deck 65, which provides work areas for workers, remains stationary even while the cutter supporting body 3 is tunneling ahead and can therefore provide a stable work environment for workers.

Roof bolters or rock bolting devices 21 are provided on the front portions 65*a* of the working decks 65 and located directly to the rear of the upper bearing frame 15. The roof bolters 21 fire roof bolts 66 into the roof 12*b* of the excavation 12. The roof bolters 21 fire the roof bolts 66 into the roof 12*b* of the excavation 12 exposed to the rear of the upper bearing frame 15 as the cutter supporting body 3 moves forward. The roof bolts 66 provide support the roof 12*b* of the excavation 12 so that the roof 12*b* does not fall in. The roof bolters 21 are installed on the working deck 65 and can therefore be held stationary with respect to the excavation 12, regardless of the advance of the cutter supporting body 3 within the range of the extension stroke of the propulsion jacks 56. As a result, the firing of the roof bolts 66 can be carried out at the same time that the cutter supporting body 3 is moving forwards (tunneling).

Referring to FIG. 4, the roof 12*b* of the excavation 12 formed by excavation with the cutters 2 is generally in a state where it can easily fall as stress supported up to then by the earth is released all at once. In the illustrated embodiment, the roof 12*b* is immediately supported by the upper bearing frame 15 so that such a fall is prevented by the pressure from the upper bearing frame 15. Accordingly, the roof 12*b* enters a stable state because the stress is gradually released during travel of the upper bearing frame 15. After that, the fall is prevented by the roof bolts 66 struck into the roof 12*b* by the roof bolters directly after the roof is exposed to the rear of the upper bearing frame 15.

Figure 7:
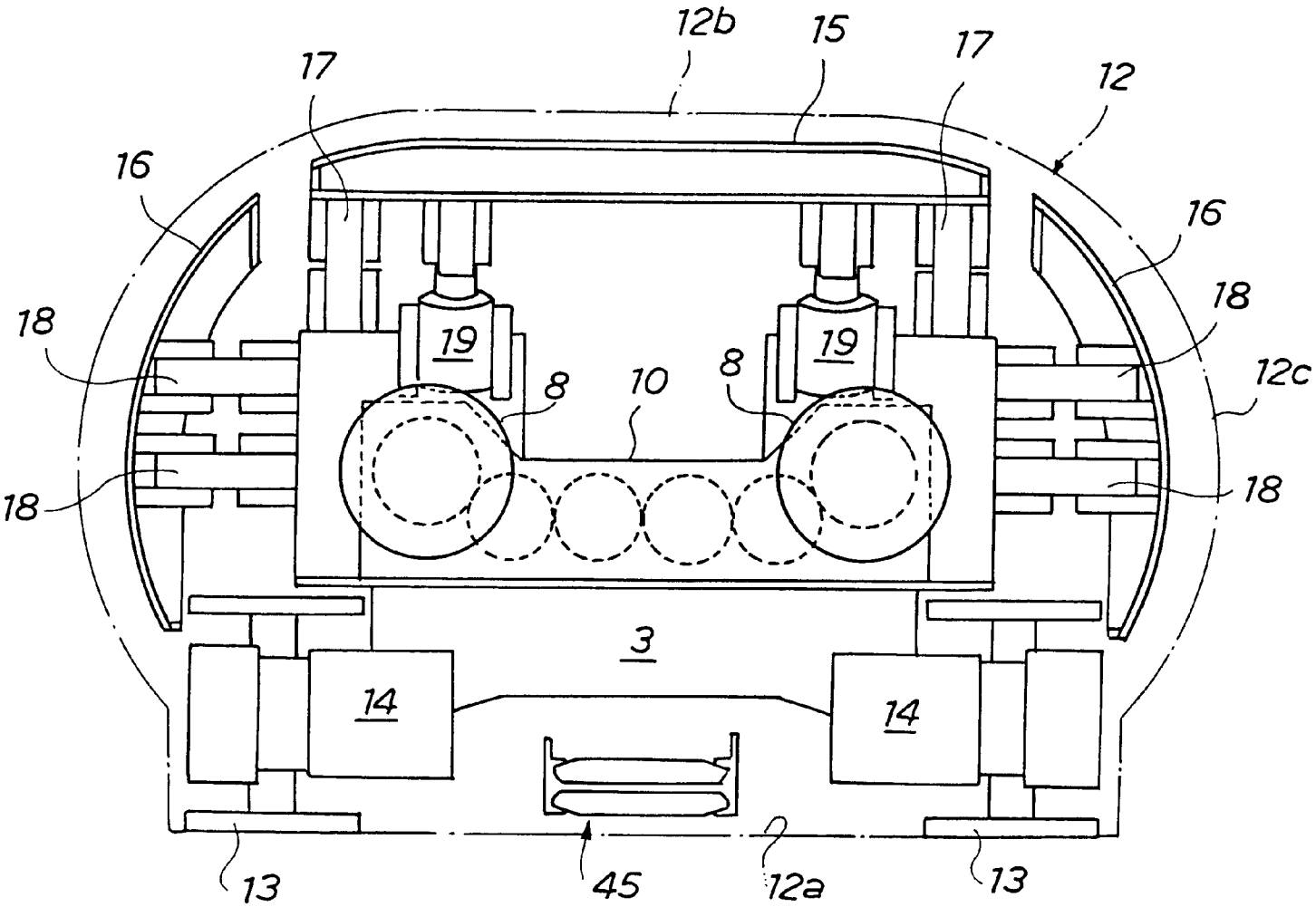
FIG. 7 is a diagram similar to FIG. 6 showing the action of the bearing frames.

As illustrated in FIG. 7, backwards movement of the tunnel excavator 1 is achieved by reverse rotation of the crawlers 13, 53 with the bearing frames 15, 16 withdrawn from the inner surface of the excavation 12 and moving the anchor body 54 and cutter supporting body 3 backwards as a single unit. It is of course that the upper bearing frame 15 is lowered by an amount sufficient for the upper bearing frame 15 not to interfere with the roof bolts 66 installed in the roof 12*b* of the excavation 12.

Figure 12:
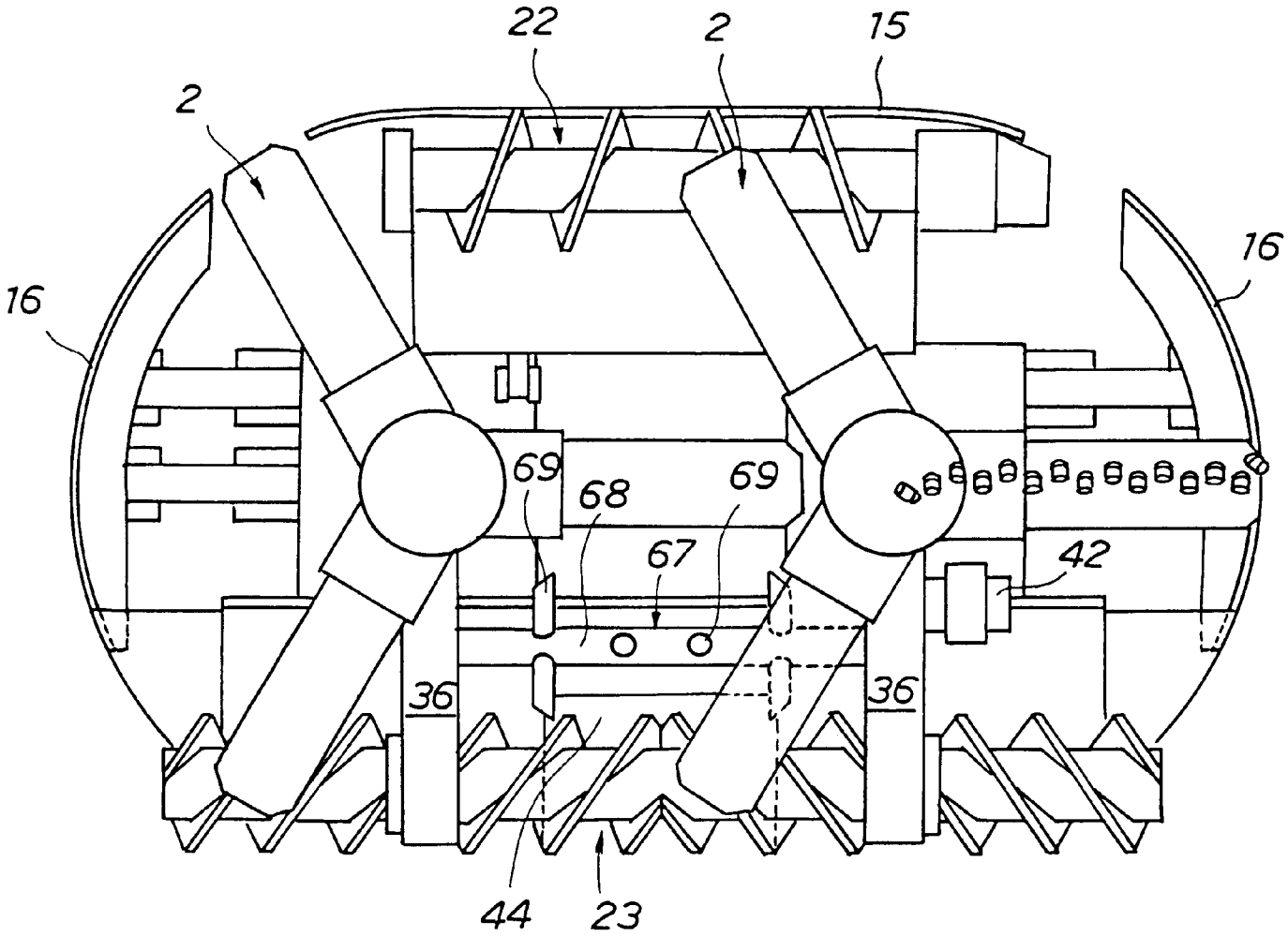
FIG. 12 is a view similar to FIG. 5 illustrating a front view of another tunnel excavator according to a second embodiment of the present invention.
Figure 13:
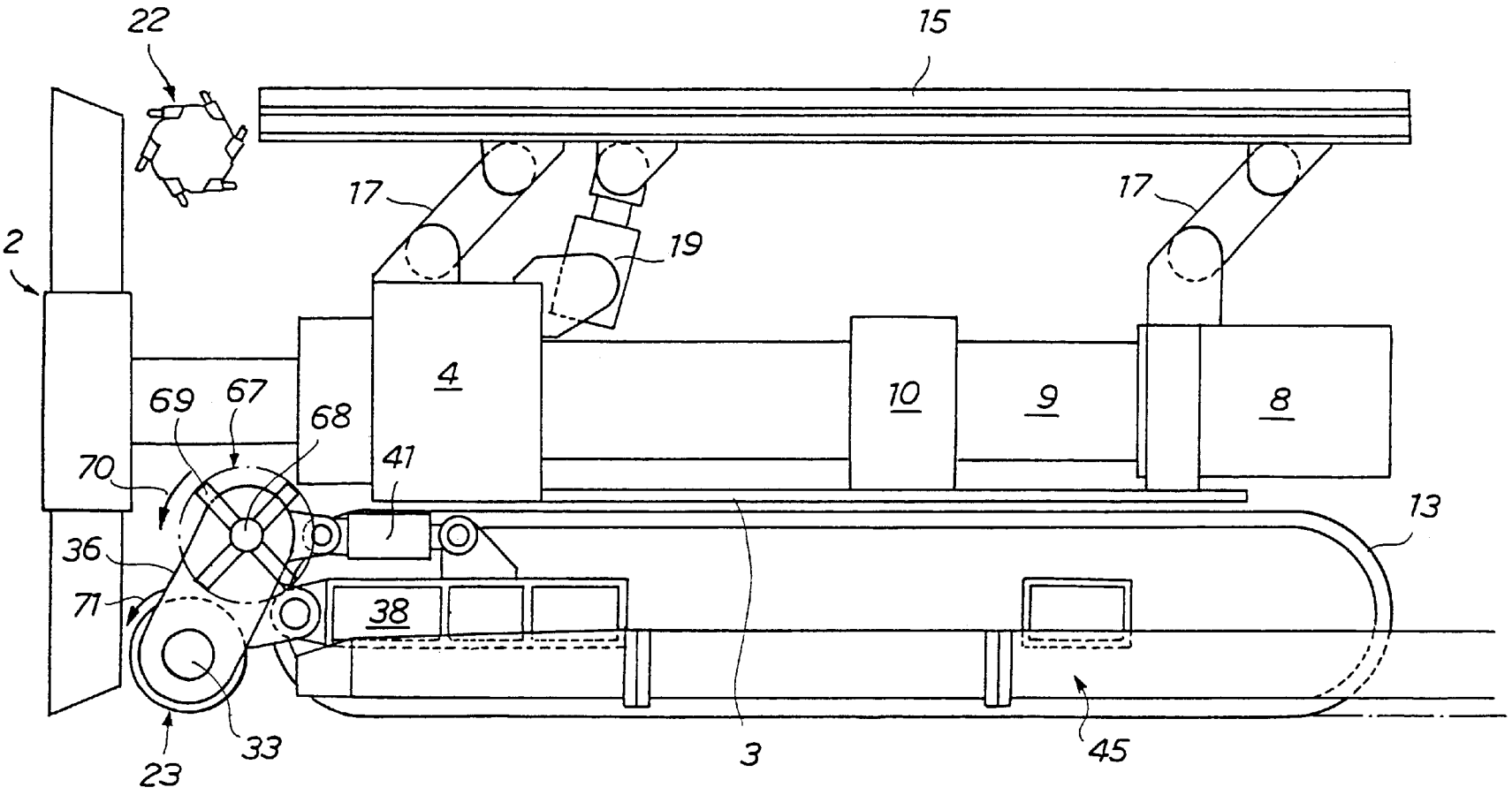
FIG. 13 is a view similar to FIG. 9 illustrating a side view of the tunnel excavator shown in FIG. 12.
Figure 14:
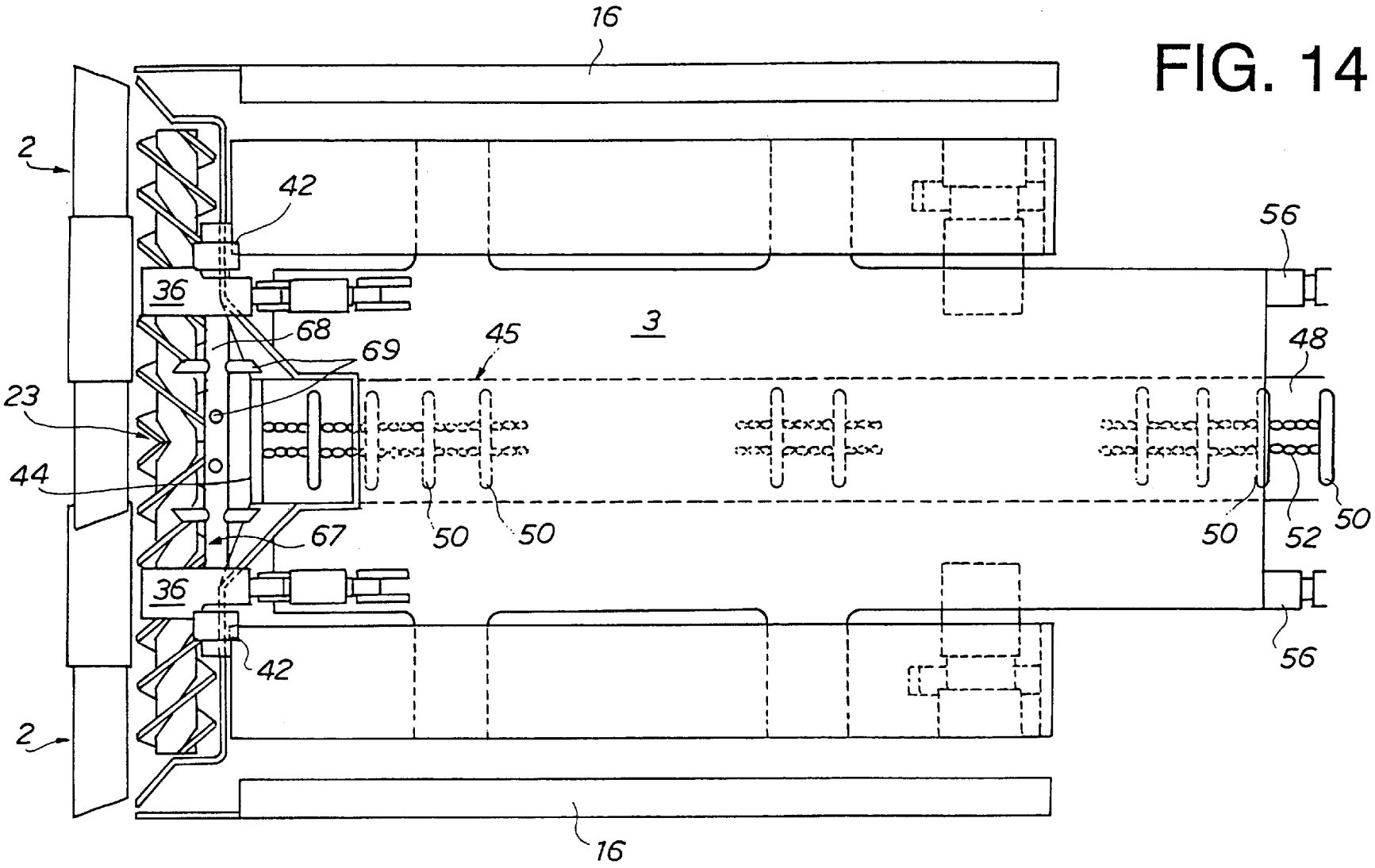
FIG. 14 is a view similar to FIG. 11 illustrating a plan view of the tunnel excavator shown in FIG. 12.

FIGS. 12 through 14 illustrate a modification. Specifically, these drawings show the tunnel excavator 1 equipped with a collecting paddle unit 67. The collecting paddle unit 67 guides the spoil excavated by the cutters 2 and sub-cutters 22, 23 to the outlet 44. The collecting paddle unit 67 include a rotary shaft 68 supported between right and left arm elements 36, and rods 69 mounted on and radiating from the rotary shaft 68. The rotary shaft 68 is connected to and rotated by the driving motor 42 for driving the lower sub-cutter 23, by means of chains and rows of gears housed within the arm elements 36, as shown by arrows 70, 71 in FIG. 13. The spoil is thereby moved with great efficiency to the outlet 44.

This application claims the priority rights of Japanese Patent Application No. 10-141511 filed May 22, 1998

What is claimed is:

1. A tunnel excavator comprising:

a cutter supporting body provided with cutters for excavating earth to form an excavation;

crawlers provided on said cutter supporting body for moving the tunnel excavator backwards and forwards; and bearing frames provided on said cutter supporting body in such a manner as to be able to move generally radiantly from said cutter supporting body until they contact and support an inner surface of the excavation, wherein said bearing frames include an upper bearing frame extending over a top of said cutter supporting body, and side bearing frames extending along sides of said cutter supporting body respectively.

2. The tunnel excavator according to claim 1 further including first jacks located between said upper bearing frame and a top of said cutter supporting body and between said side bearing frames and sides of said cutter supporting body for moving said upper and side bearing frames radiantly from said cutter supporting body respectively.

3. The tunnel excavator according to claim 2, wherein said first jacks are controlled with respect their extension force in such a manner that said upper and side bearing frames are in light contact with the inner surface of the excavation.

4. The tunnel excavator according to claim 1 further including a plurality of propulsion jacks, and an anchor body which is provided with separate crawlers and disposed separately from said cutter supporting body, said anchor body and cutter supporting body being connected by means of said plurality of propulsion jacks.

5. The tunnel excavator according to claim 4, wherein said plurality of propulsion jacks are located at points spaced from one another crosswise of said anchor body.

6. The tunnel excavator according to claim 5, wherein said plurality of propulsion jacks are controllable in terms of stroke and extension force respectively.

7. The tunnel excavator according to claim 4 further including grippers provided on said anchor body and being able to press against or separate from the inner surface of the excavation.

8. The tunnel excavator according to claim 7, wherein said grippers include swingable first arms extending from said anchor body, jacks for causing said swingable arms to swing, and shoes mounted on said swingable first arms so that the shoes contact the inner surface of the excavation.

9. The tunnel excavator according to claim 4 further including a working deck mounted on said anchor body, and a rock bolting device provided on said working deck.

10. The tunnel excavator according to claim 9, wherein said rock bolting device is located directly behind said upper bearing frame.

11. The tunnel excavator according to claim 1 further including a sub-cutter provided on said cutter supporting body and movable upwards and downwards within a prescribed range for varying a height of a crawler travel surface.

12. The tunnel excavator according to claim 11, wherein said sub-cutter includes a rotatable shaft extending horizontally behind said cutters, and two screw blades provided on said rotatable shaft and spiraling in opposite directions toward the center from each end of the rotatable shaft.

13. The tunnel excavator according to claim 12, wherein said rotatable shaft of said sub-cutter is supported by said cutter supporting body by means of second arms swingably extending from said cutter supporting body.

14. A tunnel excavator comprising:

a cutter supporting body provided with cutters for excavating the earth to form a tunnel excavation and also provided with a cutter drive mechanism located backwardly of the cutters for driving the cutters;

crawlers provided on said cutter supporting body for moving the tunnel excavator backwards and forwards; and bearing frames provided on said cutter supporting body in such a manner as to be able to move generally radiantly from said cutter supporting body until they contact and support an inner surface of the excavation, said bearing frames including an upper bearing frame extending over a top of said cutter supporting body, and side bearing frames extending along sides of said cutter supporting body respectively, the extent of said bearing frames in the direction backwardly of the cutters being sufficient to cause the bearing frames to extend over and along the cutter drive mechanism to prevent earth material adjacent the inner surface of the excavation from falling onto the cutter drive mechanism.

* * * * *